US007188878B1

(12) United States Patent
Kraus

(10) Patent No.: US 7,188,878 B1
(45) Date of Patent: Mar. 13, 2007

(54) WASTE COLLECTION DEVICES

(76) Inventor: Susan Krieger Kraus, 595 Graham Rd., Cuyahoga Falls, OH (US) 44221

( * ) Notice: Subject to any disclaimer, the term of this patent is extended or adjusted under 35 U.S.C. 154(b) by 0 days.

(21) Appl. No.: 11/391,881

(22) Filed: Mar. 28, 2006

(51) Int. Cl.
*A01K 29/00* (2006.01)
*E01H 1/12* (2006.01)

(52) U.S. Cl. ..... 294/1.4; 248/101

(58) Field of Classification Search ..... 294/1.1, 294/1.3, 1.4, 1.5; 248/101; 15/257.1
See application file for complete search history.

(56) References Cited

U.S. PATENT DOCUMENTS

| | | | | |
|---|---|---|---|---|
| 3,431,008 A | | 3/1969 | Takeki | |
| 3,659,891 A | * | 5/1972 | Pettenon et al. | 294/1.4 |
| 4,200,321 A | | 4/1980 | Warkentin | 294/1 |
| 4,225,174 A | | 9/1980 | Hennessy et al. | 294/113 |
| 4,368,907 A | | 1/1983 | Ross | 294/1 |
| 4,398,759 A | | 8/1983 | Manola | 294/1 |
| 4,447,082 A | * | 5/1984 | Lindholm | 294/1.4 |
| 4,705,310 A | * | 11/1987 | Scripter | 294/1.4 |
| 4,958,871 A | * | 9/1990 | Hemans | 294/1.4 |
| 5,320,393 A | | 6/1994 | Cortinas | 294/1.4 |
| 5,413,394 A | * | 5/1995 | Mitchell | 294/1.1 |
| 5,799,993 A | * | 9/1998 | Lafferty | 294/1.4 |
| 5,820,179 A | | 10/1998 | Tsou | 294/1.4 |
| 5,915,769 A | * | 6/1999 | Kidd | 294/1.4 |
| 5,971,452 A | * | 10/1999 | Marymor et al. | 294/1.5 |
| 6,135,520 A | | 10/2000 | Miller et al. | 294/1.4 |

* cited by examiner

*Primary Examiner*—Dean J. Kramer
(74) *Attorney, Agent, or Firm*—Renner, Kenner, Greive, Bobak, Taylor & Weber

(57) ABSTRACT

Waste collecting devices provide for orienting a disposable bag about the waste-contacting elements of the device in order to protect them from unwanted soiling by contact with the waste to be collected. The disposable bag is preferably a common grocery bag (or "t-shirt" bag), the most common of which is a plastic ⅙ barrel bag.

8 Claims, 4 Drawing Sheets

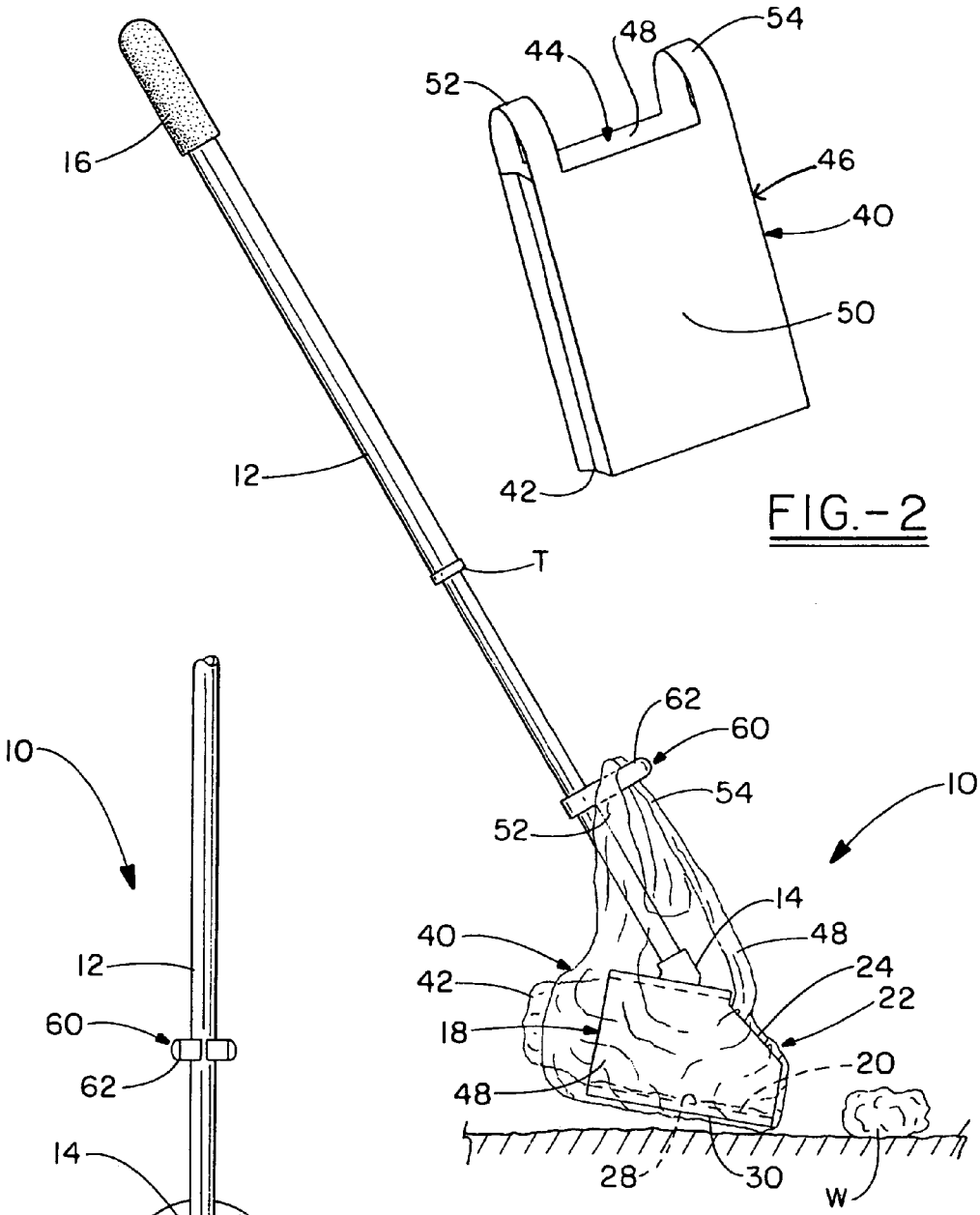
FIG.-3
FIG.-2
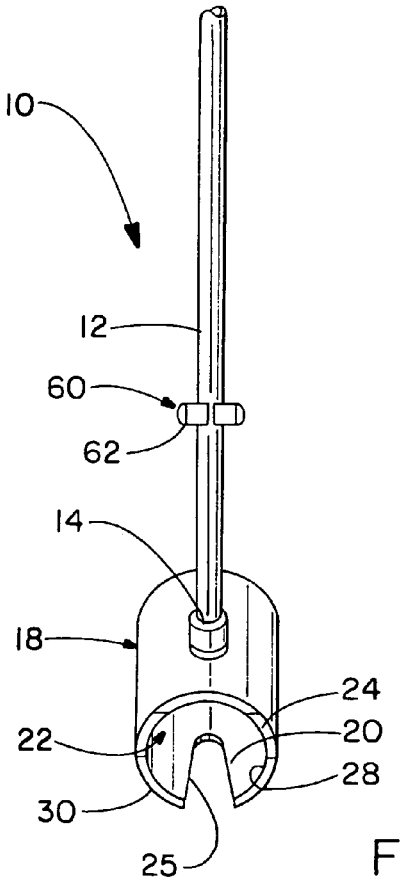
FIG.-1

FIG.-5
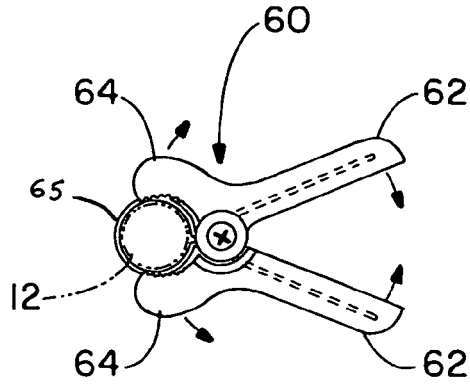
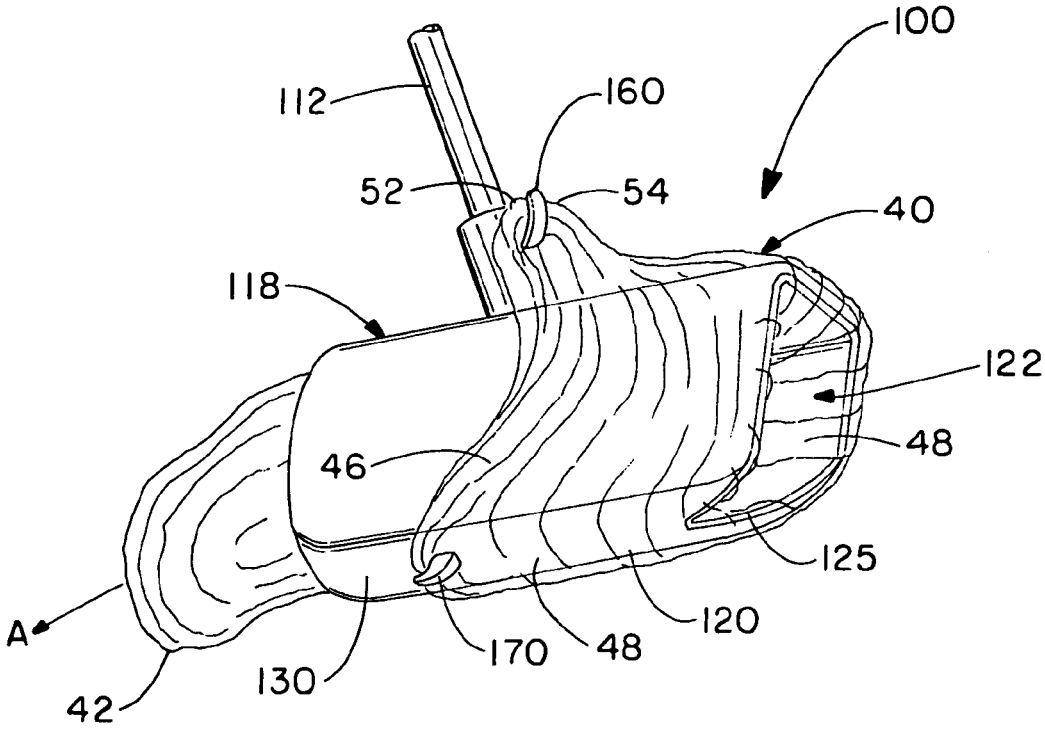
FIG.-6

WASTE COLLECTION DEVICES

TECHNICAL FIELD

The present invention generally resides in the art of waste collection devices, particularly those that are employed to collect and dispose of animal waste, although the use of this invention is not limited thereto.

BACKGROUND OF THE INVENTION

Various waste collection devices are provided in the prior art. Some use cooperating jaws that are operated by manipulating a squeeze handle to close those jaws around waste material. Others include disposable bags having their mouths secured around a frame. Waste is scooped up into the bag at the open mouth, and a squeeze handle or similar mechanism is actuated to bring a pivoting door against the open mouth to close the bag around the waste. The problem with these prior art designs is that they still permit contact between the waste and elements of the device other than the disposable bag, and, thus, although the bag provides some convenience in that the collected waste can be disposed of by disposing of the bag, the device still suffers from becoming dirty and requiring cleaning. This is particularly true in the case of picking up animal waste, because it is not acceptable to allow the device to remain soiled with such waste, and the device must therefore be cleaned whenever used for animal waste.

Animal waste collection is a daily occurrence for those who must walk their pets in public areas. Because a pet owner must constantly clean up after his pet, the pet owner necessarily uses a great number of containers for such purpose. Typically, plastic bags are employed, and pet owners may spend a significant amount of money on such waste disposal bags, particularly if they are sold as part of a waste collecting device and system that requires bags specifically configured to function with the waste collecting device. In the United States and many other countries, it is common for shoppers to save plastic grocery bags for various uses around the home, and thus, the waste collecting arts would benefit from a waste collecting device that seeks to employ these bags.

In light of the foregoing, there exists a need in the art for a waste collecting device that, when used properly, will not come into direct contact with the waste to be collected except by contact with a disposable bag element associated with the waste collecting device. There further exists a need for a waste collecting device that advantageously employs common grocery bags, also known as t-shirt bags.

SUMMARY OF THE INVENTION

The present invention provides a waste collecting device that employs a waste bag to collect and hold waste. This device includes a support staff having a grip end and a scoop end. A bag frame member extends from the scoop end and provides a scoop blade spaced from the scoop end to define a bag aperture. A bag clamp is secured to the support staff to help secure a waste bag to the device. The waste bag has a closed bottom and an open top separated by a side wall. When secured to the waste collecting device, the closed bottom of the waste bag extends through the bag aperture such that an inner surface of the scoop blade of the bag frame member, faces the exterior surface of the waste bag. The open top of the waste bag is folded back onto itself to extend at least partially over the outer surface of the scoop blade such that an exterior surface of the waste bag faces the outer surface of the scoop blade, and the portion folded back is secured to the bag clamp on the support staff such that the waste bag is held open by the bag frame, with the scoop blade being at least partially protected by the interior surface of the waste bag.

BRIEF DESCRIPTION OF THE DRAWINGS

FIG. 1 is a perspective frontal view of a waste collecting device in accordance with this invention;

FIG. 2 is a side perspective view of a conventional plastic grocery bag (or T-shirt bag) as may be used with the device shown in FIG. 1;

FIG. 3 is a side elevational view illustrating how the grocery bag of FIG. 2 may be secured to the waste collecting device and how the waste collecting device may be used;

FIG. 5 illustrates the interaction between a bag clamp and the support shaft of the device;

FIG. 6 illustrates an alternative embodiment for waste collecting devices in accordance with this invention;

PREFERRED EMBODIMENT FOR CARRYING OUT THE INVENTION

Figure 4A:
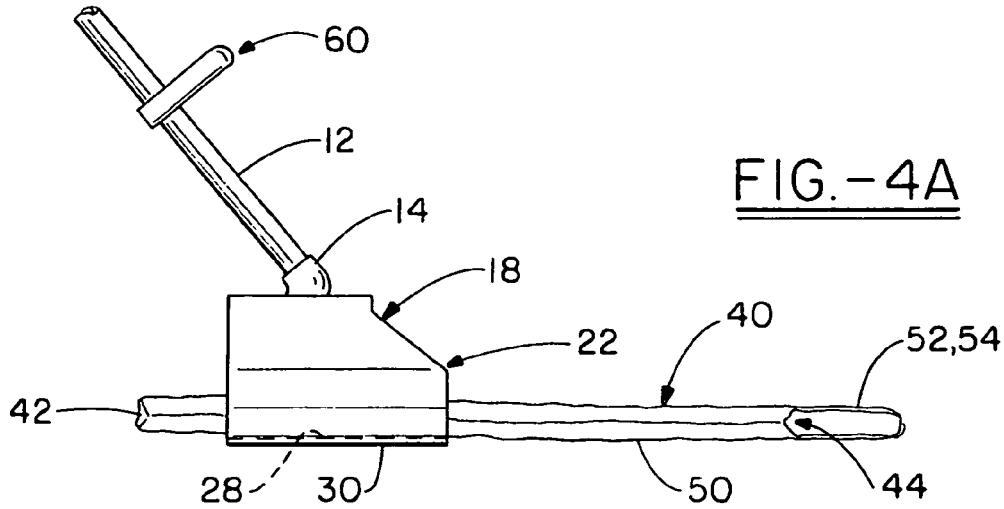
FIGS. 4A–C illustrate the manner of affixing the grocery bag of FIG. 2 to the waste collecting device.

Referring now to FIGS. 1–4, an embodiment of a waste collecting device in accordance with this invention is shown and designated by the numeral 10. Waste collecting device 10 includes support shaft 12 extending from scoop end 14 to grip end 16. Support shaft 12 may optionally be made telescopic as generally demonstrated at T, the telescoping of shaft members being well known. Bag frame member 18 extends from scoop end 14 and provides a scoop blade 20 spaced from scoop end 14 to define a bag aperture 22. Once the present disclosure is fully considered, it will be appreciated that the importance for the bag frame member is to create a bag aperture and a sufficient bottom support surface or, as named here, a "scoop blade" to contact the ground, and this can be accomplished with many structures.

In this particular embodiment, a tubular bag frame member 18 is shown, but other structures can be employed. In this tubular bag frame member embodiment, tubular bag frame member 18 is secured to scoop end 14 of support staff 12 at its outer circumference, and bag aperture 22 is defined by the open end of tubular bag frame member 18. The end of tubular bag frame member 18 opposite the open end defining bag aperture 22 could be closed if desired, but is preferably open, as seen in FIG. 3, to allow for the complete insertion of a waste bag 40, as will be described. As shown in FIGS. 1, 3, and 4A–C, bag aperture 22 may be at least partially defined by a sloped face of tubular bag frame member, as at 24. It has been found that this can facilitate the securing of a waste bag to the device, and allows one to better view how effectively he is employing the device.

In this embodiment, scoop blade 20 includes a notch 25 that extends to the open end of tubular bag frame member 18. This notch 25 can act as a guide for gathering the waste into a waste bag. It also provides a more intimate contact with the flat ground surface than does a purely tubular member. But such a notch can be employed with non tubular shaped bag frame members. It should be appreciated that a notch need not be employed to provide a suitable waste collecting device in accordance with this invention.

Before proceeding to describe the manner in which the waste bag 40 is employed, it will be beneficial to identify and name other elements of waste collection device 10, as well as to generally define a waste bag 40. Scoop blade 20 has inner surface 28 and outer surface 30. Inner surface 28 supports the waste bag 40 and, to some extent, the waste passing through bag frame member 18. Outer surface 30 contacts the ground as scoop blade 20 is slid under waste. Waste bag 40 can be made of any suitable material for picking up waste, particularly animal feces, and is preferably made of plastic. Although it will be appreciated that various types of bags can be employed for use in combination with waste collecting device 10, it is preferred that the waste collecting device be adapted to be suitable for grocery bags, also known as T-shirt bags. These bags come in various sizes, and it is particularly preferred that the waste collecting device 10 be adapted to employ ⅙ (one sixth) barrel bags. Such a bag is generally shown in FIG. 2, where waste bag 40 is defined by closed bottom 42, open top 44 and side wall 46. To aid in describing the preferred method of securing waste bag 42 to waste collecting device 10 an interior surface 48 and an exterior surface 50 of waste bag 40 are identified in the figures. Waste bag 40 includes opposed handles 52, 54 (which give it its T-shirt appearance).

Figure 4B:
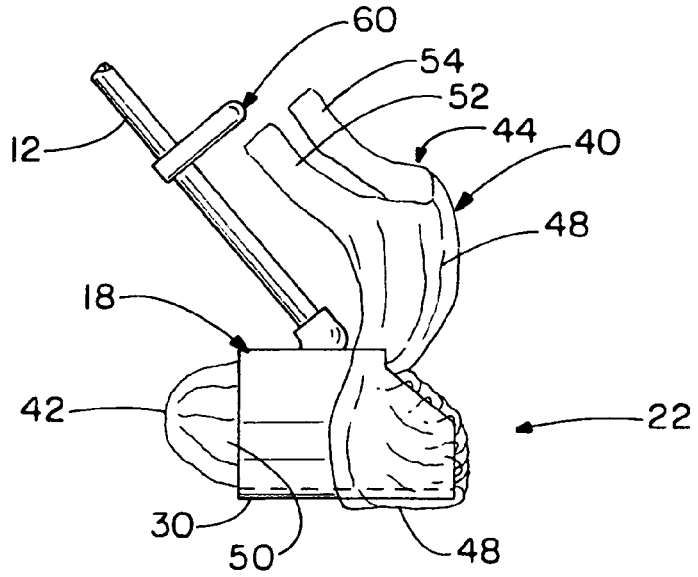
Figure 4C:
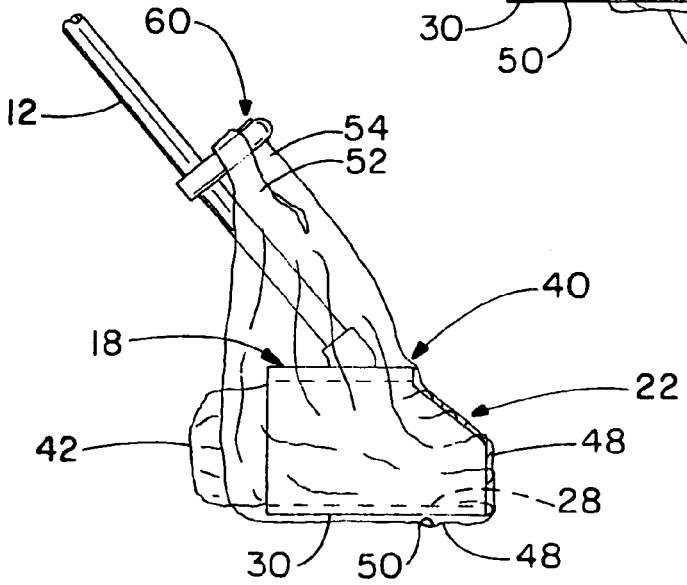

In order to describe how a waste bag 40 (or similar suitable waste bag, with or without handles) is to be employed with waste collecting device 10, reference is made to FIGS. 4A–C. As seen in FIG. 4A, closed bottom 42 of waste bag 40 is inserted to extend through bag aperture 22 such that the inner surface 28 of scoop blade 20 faces the exterior surface 50 of waste bag 40, with open top 44, and, in this particular embodiment, handles 52, 54, extending beyond bag aperture 22. As seen in FIG. 4B, open top 44 is then folded back onto itself around bag aperture 22 of bag frame member 18 to extend at least partially over outer surface 30 of scoop blade 20 such that the exterior surface 50 of waste bag 40 faces the outer surface 30. The portion of waste bag 40 that is folded back is secured to a bag clamp 60 on support shaft 12 so that waste bag 40 is held open by bag frame member 18, with scoop blade 20 being at least partially protected by the interior surface of the waste bag. With waste bags employing handles such as handles 52 and 54, the handles can be looped onto clamp grips 62, as shown in FIG. 4C and discussed more fully with reference to FIG. 5.

FIG. 5 shows a simple and useful clamp 60 that could be employed with this invention, but it is to be understood that other clamps might be employed, whether selectively positionable along the length of shaft 12 or stationary. Particularly when handles 52, 54 exist on a waste bag 40, a clamp such as clamp 60 is a very suitable clamp for waste collecting device 10. Clamp 60 is a scissor-type clamp wherein squeezing two opposed grip ends 62 toward each other causes two opposed clamp ends 64 to move apart. Clamp ends 64 are biased to squeeze against shaft 12, but once grips 62 are squeezed, clamp ends 64 can be distanced from support shaft 12 sufficiently to remove them completely from support shaft 12 or at least slide them along the length thereof. This permits clamp 60 to be positioned at virtually any distance on shaft 12, so long as grip ends 64 can wrap around the shaft. A clamp such as clamp 60 may optionally include a shaft wrap portion 65 that wraps around shaft 12 and connects to clamp 60. This shaft wrap portion 65 would hold clamp 60 to shaft 12 so that, although its position along shaft 12 might be changed, it cannot be easily removed. As seen in FIGS. 3 and 4C, handles 52, 54 are simply hooked over clamp grips 62, and clamp 60 is moved on shaft 12 to tighten the material of waste bag 40 that extends from clamp grips 62 to frame member 18, particularly the bottom thereof (outer surface 30). As already mentioned, other clamps can be employed, and in other manners. For instance, clamp end 64 of clamp 60 could be employed to clamp handles 52, 54 or other portion of waste bag 40 to support shaft 12.

Referring to FIG. 3, it can be seen that waste is simply scooped up into waste bag 40 by securing it to waste collecting device 10 in the manner described and thereafter advancing scoop blade 20 (now covered with waste bag 40) toward and under the waste, represented at W. Once the waste is scooped up, it can be urged into the bottom of waste bag 40, and additional waste can be picked up or waste bag 40 can be removed. To remove waste bag 40, handles 52, 54 are removed from clamps 60, and manipulated so that the open end of waste bag 40 is no longer folded back on itself (i.e., the bag is returned to its normal configuration). Notably, any waste that might have smeared on device 10 actually smears on waste bag 40 and, additionally, smears on the inside surface of waste bag 40. Also, only the handles of the waste bag need to be manipulated once the waste has been picked up. This is very clean and efficient, particularly in light of the fact that waste collecting device 10 is adapted to employ common grocery bags. Notably, many individuals have found it to be very efficient to employ grocery bags for everyday waste disposal, as evidenced by the proliferation of grocery bag holders and dispensers for domestic use.

Referring now to FIG. 6, an alternative embodiment of a waste collecting device is shown and designated by the numeral 100. Therein, like parts to the embodiment of device 10 receive like numerals, but increased by 100. Thus, support shaft 112 connects to a more box-like bag frame member 118 having a bag aperture 122, scoop blade 120 and notch 125. A stationary clamp 160 on shaft 112 received handles 52, 54 or some other portion, proximate the open top of a bag 40. As shown, "clamp" 160 is actually more accurately a hook member. Bag 40 is also secured to a bag hook 170 on outer surface 130 of scoop blade 120 by simply piercing through sidewall 46 of bag 40. The bag 40 is pulled taut by moving closed bottom 42 in the direction of arrow A. This device 100 still employs, in its preferred embodiment, waste bag 40.

Figure 8:
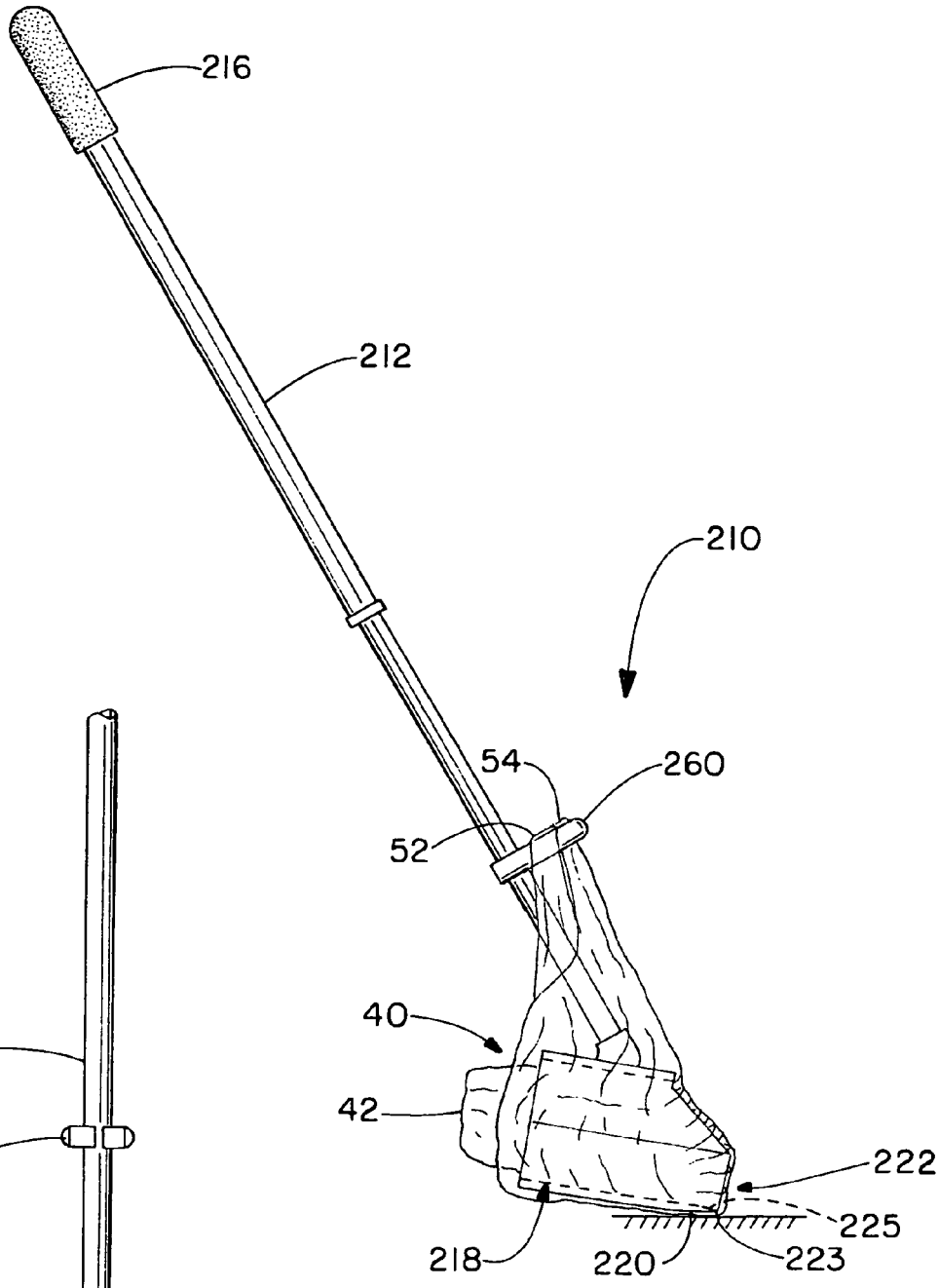
FIG. 8 is a side elevational view illustrating how the grocery bag of FIG. 2 may be secured to the waste collecting device and how the waste collecting device may be used.
Figure 7:
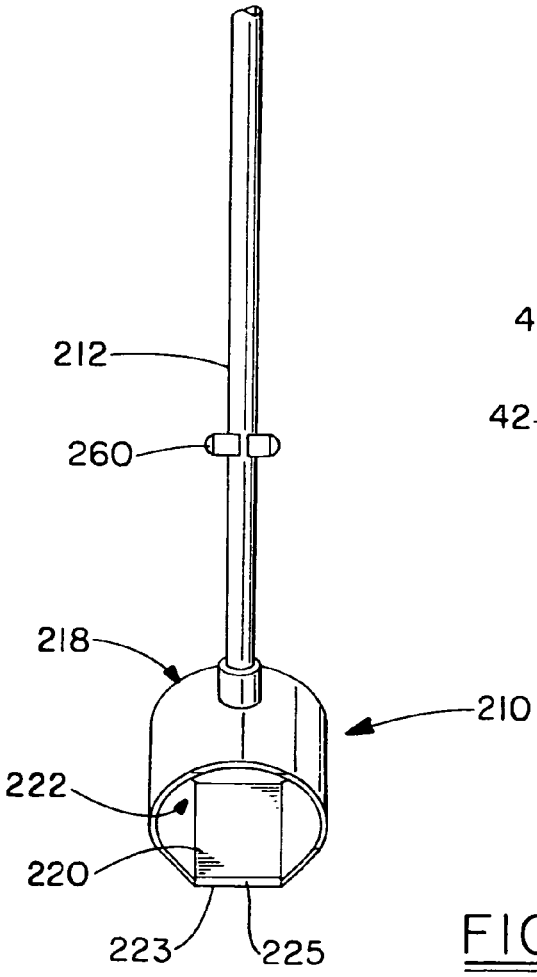
FIG. 7 is a perspective frontal view of yet another embodiment for waste collecting devices in accordance with this invention.

Another embodiment is shown in FIGS. 7 and 8, wherein like parts to the embodiment of device 10 receive like numerals, but increased by 200. Thus, waste collecting device 210 has support shaft 212 connecting, if desired, at an angle, to bag frame member 218 having bag aperture 222 and scoop blade 220. This embodiment has no notch in scoop blade 220, rather, scoop blade 220 extends upwardly at front edge 223 to define a scoop ramp 225. As seen in FIG. 8, when picking up waste (not shown, though it should be appreciated that it would be positioned substantially as with waste W of FIG. 3), bag frame 218 is tilted slightly forward, placing scoop ramp 225 flush on the ground surface to then be advanced under the waste with a bag 40 properly secured to bag frame member 218 and bag clamp 260. This has been found to be a helpful alteration to the design of a bag frame member. This embodiment also differs from others in that the general tube shape of bag frame member 218 is flattened at scoop blade 220 so that it can more intimately contact the ground surface.

In light of the foregoing, it should thus be evident that the present invention provides improvements in waste collection devices. In accordance with the patent statutes, only the preferred embodiments of the present invention have been described in detail hereinabove, and the present invention is not to be limited thereto or thereby. The scope of the invention shall include all modifications and variations that fall within the scope of the attached claims.

What is claimed is:

1. A waste collecting device comprising:

a support shaft having a grip end and a scoop end;

a bag frame member extending from said scoop end and providing a scoop surface spaced from said scoop end of said support staff to define a bag aperture, said scoop surface including an inner surface and an outer surface;

a bag clamp movably secured to said support staff to be positioned at selective distances from said scoop end, said bag clamp having opposed bag handle receipts;

a waste bag having a closed bottom and an open top separated by a sidewall and defining an interior surface and an exterior surface, said waste bag having opposed handles positioned proximate said open top thereof, wherein said closed bottom extends through said bag aperture such that said inner surface of said scoop surface faces said exterior surface of said waste bag, and said open top is folded back onto itself to extend at least partially over said outer surface of said scoop surface such that said exterior surface of said waste bag faces said outer surface of said scoop surface, and is secured to said bag clamp on said support staff with said opposed handles being secured to said bag clamp on said opposed bag handle receipts such that said waste bag is held open by said bag frame member, with said scoop surface being at least partially protected by said interior surface of said waste bag.

2. The waste collecting device of claim 1, wherein said scoop surface includes an upwardly extending front scoop edge, said open top of said waste bag being folded back onto itself over said front edge.

3. The waste collecting device of claim 1, wherein said bag frame member is a tubular bag frame member secured to said support staff at its outer circumference, said bag aperture being defined by an open end of said tubular bag frame member.

4. The waste collecting device of claim 1, wherein said waste bag is a plastic ⅙ barrel bag.

5. The waste collecting device of claim 1, wherein said bag clamp is a scissor-type clamp member having opposed jaws biased to close on said support shaft and said opposed bag handle receipts are opposed pinch grips that can be manipulated to open said jaws against such bias.

6. The waste collecting device of claim 5, wherein said opposed handles are secured to said bag clamp on said pinch grips.

7. The waste collecting device of claim 1, wherein said support shaft is telescoping.

8. The waste collecting device of claim 1, wherein said support shaft is on an angle.

* * * * *